US005852887A

United States Patent [19]

Healy et al.

[11] Patent Number: 5,852,887

[45] Date of Patent: Dec. 29, 1998

[54] SHOE WITH LATERAL SUPPORT MEMBER

[75] Inventors: John Healy, Madbury; Craig Wojceiszak, Stratham, both of N.H.; Mary-Patricia Adamo, Wakefield, Mass.

[73] Assignee: Converse Inc., North Reading, Mass.

[21] Appl. No.: 908,027

[22] Filed: Aug. 14, 1997

[51] Int. Cl.[6] ..... A43B 7/14; A43B 13/12

[52] U.S. Cl. ..... 36/88; 36/69; 36/30 R

[58] Field of Search ..... 36/88, 69, 140, 36/25 R, 30 R

[56] References Cited

U.S. PATENT DOCUMENTS

| | | | |
|---|---|---|---|
| D. 287,902 | 1/1987 | Forsyth . | |
| D. 354,616 | 1/1995 | Schroer, Jr. . | |
| 1,132,096 | 3/1915 | Jaedike | 36/69 |
| 1,847,973 | 3/1932 | Morton . | |
| 2,785,480 | 3/1957 | Maccarone . | |
| 4,506,460 | 3/1985 | Rudy | 36/69 |
| 4,546,559 | 10/1985 | Dassler . | |
| 4,559,724 | 12/1985 | Norton . | |
| 4,769,927 | 9/1988 | Liggett et al. | 36/88 |
| 4,811,500 | 3/1989 | Maccano . | |
| 4,866,861 | 9/1989 | Noone | 36/69 |
| 4,941,273 | 7/1990 | Gross . | |
| 5,046,267 | 9/1991 | Kilgore et al. . | |
| 5,052,130 | 10/1991 | Barry et al. . | |
| 5,109,613 | 5/1992 | Van Dyke . | |
| 5,224,280 | 7/1993 | Preman et al. | 36/30 R |
| 5,274,932 | 1/1994 | Malloy . | |
| 5,279,051 | 1/1994 | Whatley . | |
| 5,297,349 | 3/1994 | Kilgore . | |
| 5,313,717 | 5/1994 | Allen et al. . | |
| 5,315,769 | 5/1994 | Barry et al. . | |
| 5,317,820 | 6/1994 | Bell et al. | 36/69 |
| 5,319,866 | 6/1994 | Foley et al. . | |
| 5,379,530 | 1/1995 | Bell et al. | 36/69 |
| 5,408,761 | 4/1995 | Gazzano | 36/69 |
| 5,448,839 | 9/1995 | Blissett et al. . | |
| 5,461,801 | 10/1995 | Anderton . | |
| 5,465,509 | 11/1995 | Fuerst et al. . | |
| 5,528,842 | 6/1996 | Ricci et al. . | |
| 5,561,920 | 10/1996 | Graham et al. . | |

FOREIGN PATENT DOCUMENTS

| | | | |
|---|---|---|---|
| 146208 | 6/1985 | European Pat. Off. | 36/69 |
| 2 267 425 | 8/1993 | United Kingdom . | |
| WO91/09546 | 11/1991 | WIPO . | |

*Primary Examiner*—M. D. Patterson
*Attorney, Agent, or Firm*—Howell & Haferkamp, L.C.

[57] ABSTRACT

A shoe of the present invention comprises a sole, an upper secured to the sole, and a lateral support member. The sole includes an outsole and a midsole. At least a portion of the midsole overlies at least a portion of the outsole. The lateral support member is positioned generally between the midsole and outsole. The lateral support member includes a transverse portion and an upstanding portion. The transverse portion comprises an inner section spaced laterally from the upstanding portion and a ramped section between the inner section and the upstanding portion. The transverse portion extends laterally relative to the midsole from an area generally adjacent a first side of the midsole toward an opposite second side of the midsole. The ramped section inclines upwardly from a bottom section of the upstanding portion toward the inner section of the transverse portion. The upstanding portion is connected to and extends upwardly from the ramped portion adjacent the first side of the midsole. The inner section, ramped section, and upstanding portion are configured so that movement of the inner section from an up position to a down position effectuates movement of a top section of the upstanding portion from an out position to an in position to provide improved lateral support to a wearer's foot.

26 Claims, 2 Drawing Sheets

SHOE WITH LATERAL SUPPORT MEMBER

BACKGROUND OF THE INVENTION

This invention relates to shoes having support features, and more particularly to such shoes having support features which provide lateral support to a wearer's foot. The shoe construction of the invention is preferably employed in athletic shoes, but may be employed in various other types of shoes as well.

A conventional athletic shoe includes an outsole, a midsole overlying the outsole, and an upper secured to the midsole. Generally, the midsole is formed from a resilient foam material which provides at least some cushioning and support to the athlete's foot. Many conventional athletic shoes include other features which serve to provide added support.

For example, various types of fluid filled bladders or pads, containing air or liquid, have been employed in the construction of athletic shoes to provide cushioning and support to the shoe wearer's foot. The fluid filled bladders are frequently positioned in the heel areas of shoe soles since, in a normal walking or running gait, the heel area of the foot usually strikes the ground first at each footfall. For certain other activities, such as basketball and tennis, lateral cutting movements of the athlete frequently result in the forefoot area of the foot, or the lateral or medial sides of the foot, striking the ground first. In shoes specially designed for these types of activities, bladders or pads are positioned in the forefoot area, and usually beneath the second metatarsal head, i.e., the "ball" of the foot. Although these bladders or pads serve to absorb and redistribute downward vertical forces resulting from footstep impact, they fail to provide adequate lateral support to the athlete's foot when extreme lateral cutting movements are made.

Other prior art athletic shoe constructions include midsoles or outsoles having portions which extend upwardly and overlap a portion of the shoe upper to provide lateral support to the athlete's foot. However, these overlapping portions of the sole alone also fail to provide adequate lateral support to the athlete's foot when extreme lateral cutting movements are made.

SUMMARY OF THE INVENTION

It is an object of the present invention to provide a shoe construction which is configured for translating downward forces resulting from footstep impact into lateral forces applied to the shoe wearer's foot to thereby provide improved lateral support. Another object of this invention is to provide a shoe construction which enhances the performance of the shoe wearer by providing improved support to the shoe wearer's foot. Still another object is to provide a shoe construction which is an improvement over conventional shoe constructions.

In general, a shoe of the present invention comprises a sole, an upper secured to the sole, and a lateral support member. The sole includes an outsole and a midsole. At least a portion of the midsole overlies at least a portion of the outsole. The outsole has top and bottom surfaces. The lateral support member includes a transverse portion and an upstanding portion extending up from the transverse portion. The transverse portion is positioned generally between the midsole and outsole and extends laterally relative to the midsole from a first side of the midsole toward an opposite second side of the midsole. The upstanding portion extends upwardly from the transverse portion adjacent the first side of the midsole.

The transverse portion is moveable between up and down positions. In its up position, the transverse portion is spaced a first vertical distance from the bottom surface of the outsole. In its down position, the transverse portion is spaced a second vertical distance from the bottom surface of the outsole, the second vertical distance being shorter than the first vertical distance. The upstanding portion has a top section moveable between out and in positions. In its out position, the top section of the upstanding portion is spaced a first lateral distance from the second side of the midsole. In its in position, the top section of the upstanding portion is spaced a second lateral distance from the second side of the midsole, the second lateral distance being shorter than the first lateral distance. The transverse portion and the upstanding portion are configured so that movement of the transverse portion from its up position to its down position induces movement of the top section of the upstanding portion from its out position to its in position to thereby provide lateral support to a wearer's foot.

In another aspect of the present invention, a lateral support member includes a transverse portion and an upstanding portion. The transverse portion is comprised of an inner section spaced laterally from the upstanding portion and a ramped section between the inner section and the upstanding portion. The upstanding portion extends upwardly from the ramped section. The transverse portion extends laterally relative to the midsole from an area generally adjacent a first side of the midsole toward an opposite second side of the midsole. The ramped section inclines upwardly from a bottom section of the upstanding portion toward the inner section. The upstanding portion extends upwardly from the ramped section adjacent the first side of the midsole. The inner section is moveable between up and down positions. The upstanding portion has a top section moveable between out and in positions. The inner section, ramped section, and upstanding portion are all configured so that movement of the inner section from its up position to its down position effectuates movement of the top section of the upstanding portion from its out position to its in position. The upstanding portion is positioned and configured so that, when the top section is in its in position, the upstanding portion provides lateral support to a wearer's foot.

Other objects and features will be in part apparent and in part pointed out hereinafter.

BRIEF DESCRIPTION OF THE DRAWINGS

Reference characters in the written specification indicate corresponding parts throughout the several views of the drawings.

DETAILED DESCRIPTION OF THE PREFERRED EMBODIMENTS

Figure 1:
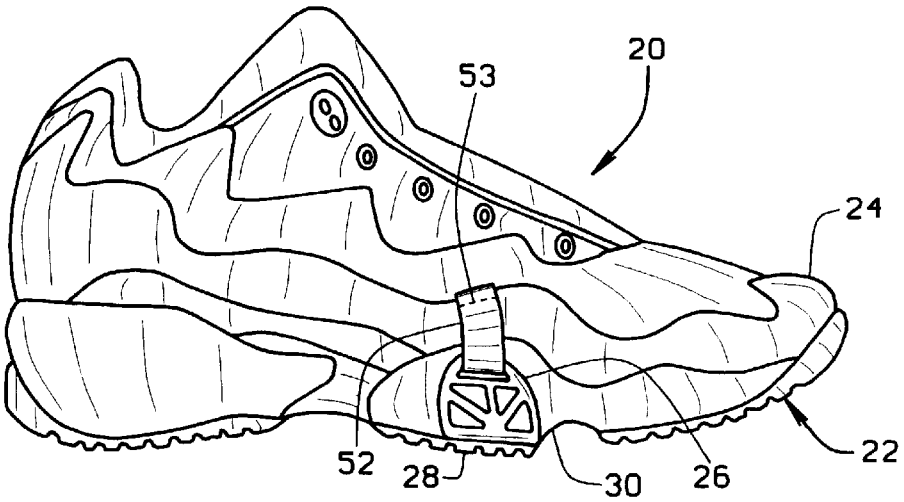
FIG. 1 is a side elevational view of a shoe of the present invention having an outsole, midsole, upper, and lateral support member.

Referring to FIGS. 1–5, a shoe of the present invention is indicated in its entirety by the reference numeral 20. Generally, the shoe 20 comprises a sole 22, an upper 24 secured to the sole 22, and a lateral support member 26. The sole 22 includes an outsole 28 and a midsole 30. The outsole 28 has a top surface 32 (FIG. 4) and a bottom surface 34 (FIG. 4) and, as shown in FIG. 1, the midsole 30 at least partially overlies the outsole 28.

Figure 3:
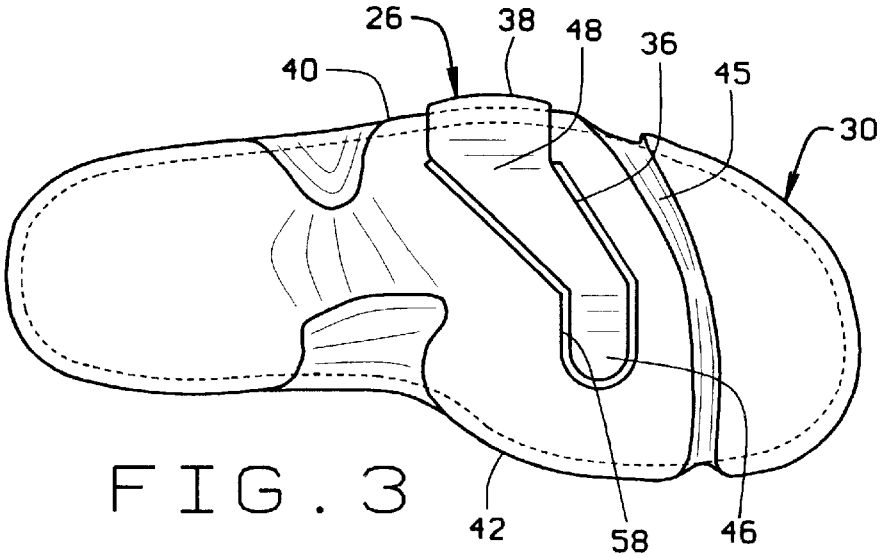
FIG. 3 is a bottom view of the shoe of FIGS. 1 and 2 with the outsole removed to show detail of the midsole and lateral support member.
Figure 4:
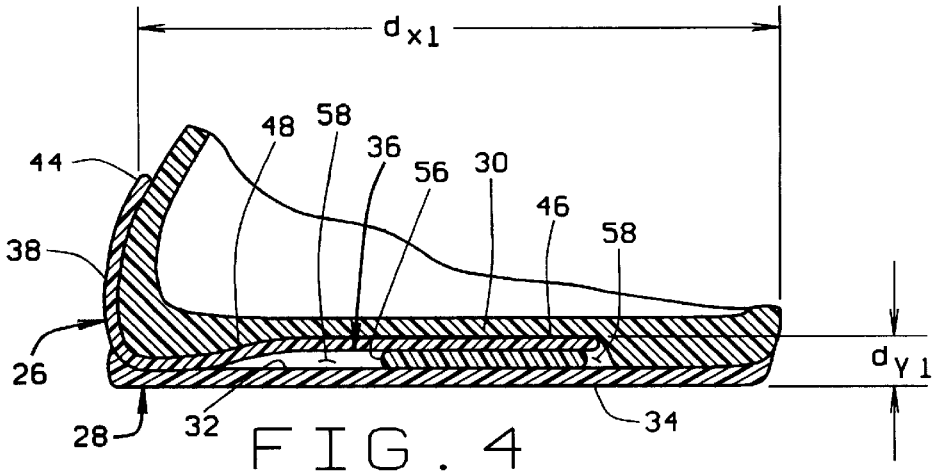
FIG. 4 is an enlarged, fragmented cross-sectional view taken along the plane of line 4—4 in FIG. 2 showing a transverse portion of the lateral support member in an up position, and showing a top section of an upstanding portion of the lateral support member in an out position.
Figure 5:
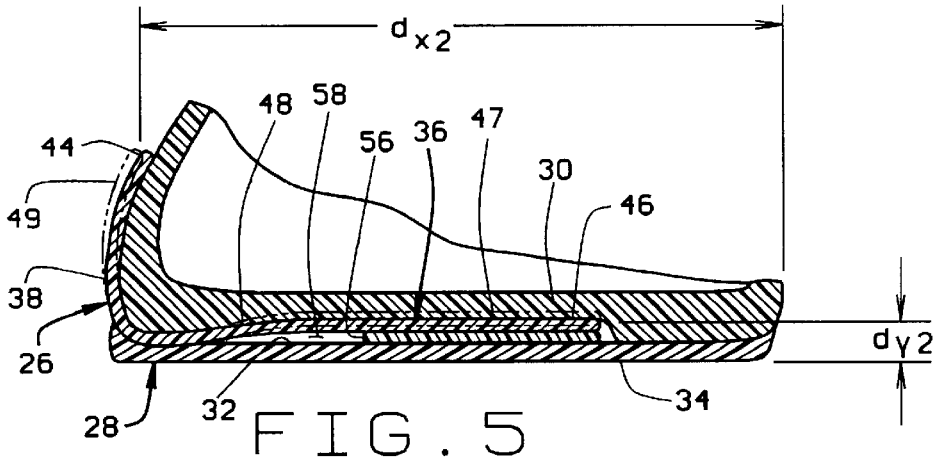
FIG. 5 is an enlarged, fragmented cross-sectional view similar to that of FIG. 4 but showing the transverse portion of the lateral support member in a down position, and showing the top section of the upstanding portion of the lateral support member in an in position.

As best shown in FIGS. 3–5, the lateral support member 26 includes a transverse portion 36 and an upstanding portion 38. The transverse portion 36 is comprised of an inner section 46 spaced laterally from the upstanding portion 38 and a ramped section 48 between the inner section 46 and the upstanding portion 38. The upstanding portion 38 extends upwardly from the ramped section 48 adjacent the lateral side 40 of the midsole 30. Preferably, the upstanding portion 38 extends up from the transverse portion 36 and overlaps a portion of the upper 24. The transverse portion 36 is preferably positioned generally between the midsole 30 and outsole 28 and extends laterally relative to the midsole 30 from a lateral (outer) side 40 of the midsole 30 toward a medial (inner) side 42 of the midsole 30.

The inner section 46 of the transverse portion 36 is moveable between an up position (FIG. 4) and a down position (FIG. 5). For simplicity, the upper 24 is not represented in FIGS. 4 and 5. In its up position, the inner section 46 is spaced a first vertical distance $d_{y1}$ from the bottom surface 34 of the outsole 28. In its down position, the inner section 46 is spaced a second vertical distance $d_{y2}$ from the bottom surface 34 of the outsole 28, the distance $d_{y2}$ being shorter than the distance $d_{y1}$.

The upstanding portion 38 has a top section 44 moveable between an out position (see FIG. 4) and an in position (see FIG. 5). In its out position, the top section 44 of the upstanding portion 38 is spaced a first lateral distance $d_{x1}$ from the medial side 42 of the midsole 30. In its in position, the top section 44 of the upstanding portion 38 is spaced a second lateral distance $d_{x2}$ from the medial side 42 of the midsole 30, the distance $d_{x2}$ being shorter than the distance $d_{x1}$.

In FIG. 5, reference numeral 47 refers to a phantom line which represents the up position of the inner section 46 of the transverse portion 36 and reference numeral 49 refers to a phantom line which represents the out position of the top section 44 of the upstanding portion 38. The transverse portion 36 and the upstanding portion 38 are configured so that movement of the inner section 46 of the transverse portion 36 from its up position to its down position causes movement of the top section 44 of the upstanding portion 38 from its out position to its in position.

Preferably, the inner section 46, ramped section 48, and upstanding portion 38 of the lateral support member 26 constitute a monolithic piece. The lateral support member 26 should be sufficiently rigid to induce movement of the top section 44 of the upstanding portion 38 from its out position (FIG. 4) to its in position (FIG. 5) upon movement of the inner section 46 of the transverse portion 36 from its up position (FIG. 4) to its down position (FIG. 5). In the preferred embodiment, the durometer hardness of the lateral support member 26 is about 75 Shore D. The member 26 is preferably created by injection molding. Suitable injection molding materials include nylon, glass fiber reinforced nylon, ZYTEL™, and peebax. In the preferred embodiment, the lateral support member 26 is comprised of about 85% nylon 6 reinforced with about 15% glass fiber. However, other materials and other methods of construction could be used to achieve the desired performance characteristics for the lateral support member 26 without departing from the scope of the present invention. The particular materials chosen to comprise the lateral support member 26 may be varied to match the strength and performance requirements of the particular shoe.

Figure 2:
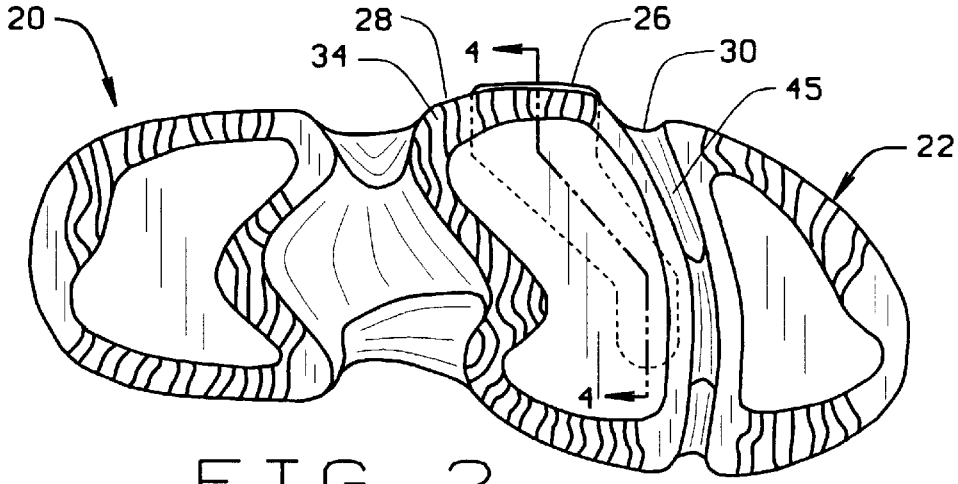
FIG. 2 is a bottom plan view of the shoe of FIG. 1 with the lateral support member shown in hidden lines.

The transverse portion 36 of the lateral support member 26 is preferably positioned between the midsole 30 and the outsole 28 so that it is aligned just rearward of a flex line 45 (FIG. 2) of the shoe 20 and follows a shape that extends adjacent the metatarsal heads of the wearer's foot. As shown in FIGS. 2 and 3, the transverse portion 36 of the lateral support member 26 preferably extends laterally from a region at the lateral side 40 of the midsole 30 adjacent the fifth metatarsal head of the wearer's foot toward the medial side 42 of the midsole 30 to a region adjacent the second metatarsal head of the wearer's foot. The area adjacent the fifth metatarsal head of the wearer's foot typically represents the widest part of the shoe on the lateral (outer) side.

The ramped section 48 is positioned between the midsole 30 and the outsole 28 and connects the upstanding portion 38 with the inner section 46. As shown in FIGS. 4 and 5, the ramped section 48 inclines upwardly from the upstanding portion 38 to the inner section 46.

The ramped section 48 enables the inner section 46 of the lateral support member 26 to be pivoted downwardly when the shoe sole is loaded. Therefore, the lateral support member acts as a lever which translates downward vertical forces resulting from forefoot impact into inward lateral forces applied by the upstanding portion 38 of the lateral support member 26 to provide improved lateral support to the wearer's foot. During forefoot impact, downward vertical forces are applied to the midsole 30 of the shoe 20 in the area of the second metatarsal head of the wearer's foot. These forces cause downward movement of the inner section 46 of the transverse portion 36 which, as explained above, induces movement of the top section 44 of the upstanding portion 38 from its out position to its in position. As the top section 44 of the upstanding portion 38 moves to its in position, it applies an inward lateral force to the wearer's foot at about the level of the fifth metatarsal just posterior to the fifth metatarsal head.

As shown in FIGS. 4 and 5, the shoe 20 also includes a resilient member 56 between the transverse portion 36 and the outsole 28 for biasing the transverse portion 36 in its up position. The resilient member 56 is compressible in order to give the inner section 46 of the transverse portion 36 of the lateral support member 26 room to move downwardly toward the outsole 28. In FIG. 5, the resilient member 56 is shown in a compressed configuration and appears somewhat flattened due to a load being applied to the transverse portion 36 of the lateral support member 26.

The resilient member 56 has a durometer hardness less than that of the outsole 28 and, due to its resiliency, improves the cushioning response in the forefoot area of the shoe 20. This also enhances the lever action of the lateral support member 26. Preferably, the resilient member 56 is formed of an elastomeric polyurethane having a durometer hardness of about 50 Shore 000. In the preferred embodiment, the outsole has a durometer hardness of about 80 Shore A.

As shown in FIGS. 4 and 5, the resilient member 56 is positioned in a cavity 58 between the transverse portion 36 and the outsole 28, and preferably only occupies a portion of the cavity 58. In the preferred embodiment, the resilient member 56 is disc-shaped or toroid-shaped and is positioned beneath the inner section 46 of the transverse portion 36 of the lateral support member 26 in the area of the second metatarsal head of the wearer's foot. In an alternative embodiment (not shown), the resilient member may occupy substantially all of the cavity 58 between the transverse portion 36 and the outsole 28. In another alternative embodiment (not shown), the resilient member may be comprised of a fluid filled bladder which occupies some or all of the area between the midsole 30 and outsole 28. In a further alternative embodiment (not shown), the resilient member may be comprised of a spring which occupies some or all of the area between the midsole 30 and outsole 28. In still another alternative embodiment (not shown), no resilient member is used in the area between the midsole 30 and outsole 28, i.e., the resilient member is replaced with a void.

Figure 6:
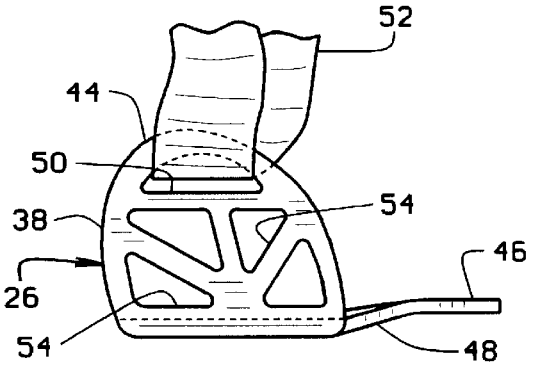
FIG. 6 is a side elevational view of the lateral support member of the shoe of FIGS. 1 through 5 shown with a support strap looped through an eyelet of the member.
Figure 7:
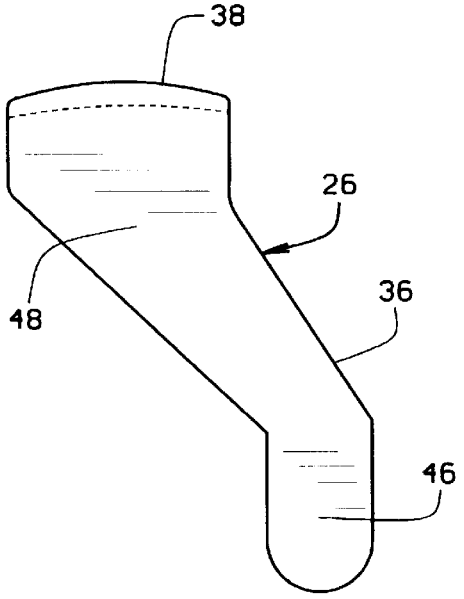
FIG. 7 is a bottom view of the lateral support member of the shoe of FIGS. 1 through 5.

As shown in FIG. 6, the upstanding portion 38 of the lateral support member 26 preferably includes an eyelet 50 configured for receiving a strap 52 looped through the eyelet 50. Preferably, the strap 52 is looped through the eyelet 50 and attached to the upper 24 of the shoe 20 with stitches 53 for enhancing lateral support (FIG. 1). Although the performance of the lateral support member 26 is not dependent on the strap 52, the strap 52 may provide additional lateral support to the shoe wearer during severe lateral movements, and may reduce the likelihood of fatigue failure of the lateral support member 26. The upstanding portion 38 may also include cored out regions 54 for reducing the overall weight of the lateral support member 26, and for allowing aesthetic customization of the member 26.

In the preferred embodiment of the invention, the support member has been described as being positioned in the forefoot area of the shoe sole extending at least from an area adjacent the fifth metatarsal head to an area adjacent the second metatarsal head. However, it should be understood that the support member may be positioned in various different areas of the shoe sole and the shoe upper to best suit its functioning for a particular purpose.

In view of the above, it will be seen that improvements over the prior art have been achieved and other advantageous results attained. As various changes could be made in the above constructions without departing from the scope of the invention, it is intended that all matter contained in the above description or shown in the accompanying drawings shall be interpreted as illustrative and not in a limiting sense. It should be understood that other configurations of the present invention could be constructed, and different uses could be made, without departing from the scope of the invention as set forth in the following claims.

What is claimed is:

1. A shoe comprising:

a sole having an outsole and a midsole with at least a portion of the midsole overlying at least a portion of the outsole, the outsole having top and bottom surfaces;

an upper secured to the sole; and a support member having a transverse portion and an upstanding portion extending up from the transverse portion, the transverse portion being positioned generally between the midsole and outsole and extending laterally relative to the midsole from a first side of the midsole toward an opposite second side of the midsole, the upstanding portion extending up from the transverse portion adjacent the first side of the midsole and overlapping a portion of the upper, the transverse portion being adapted so that an inner section of the transverse portion is moveable between an up position spaced a first vertical distance from the bottom surface of the outsole and a down position spaced a second vertical distance from the bottom surface of the outsole, the second vertical distance being shorter than the first vertical distance, the upstanding portion having a top section moveable between an out position spaced a first lateral distance from the second side of the midsole and an in position spaced a second lateral distance from the second side of the midsole, the second lateral distance being shorter than the first lateral distance, the transverse portion and the upstanding portion being configured so that movement of the inner section of the transverse portion from its up position to its down position induces movement of the top section of the upstanding portion from its out position to its in position to thereby provide lateral support to a wearer's foot, the inner section of the transverse portion being spaced laterally from the upstanding portion, the transverse Portion including a ramped section between the upstanding portion and the inner section, the ramped section inclining upwardly toward the inner section.

2. The shoe of claim 1 wherein the inner section of the transverse portion is spaced laterally from the upstanding portion, said inner section being spaced above the top surface of the outsole when the inner section is in its up position.

3. The shoe of claim 1 including a resilient member between the transverse portion and the outsole for biasing the inner section of the transverse portion toward its up position.

4. The shoe of claim 3 wherein the outsole is made of a first material and the resilient member is made of a second material, the second material having a durometer hardness less than that of the first material.

5. The shoe of claim 3 wherein the resilient member is of an elastomeric polyurethane.

6. The shoe of claim 3 wherein the resilient member occupies only a portion of a cavity between the transverse portion and the outsole.

7. The shoe of claim 3 wherein the support member is of a material having a hardness greater than a hardness of the resilient member.

8. The shoe of claim 1 wherein the transverse portion extends laterally at least from a region adjacent the fifth metatarsal head of the wearer's foot to a region adjacent the second metatarsal head of the wearer's foot.

9. The shoe of claim 1 wherein the ramped section is positioned between the midsole and the outsole.

10. The shoe of claim 1 wherein the upstanding and transverse portions constitute a monolithic piece.

11. The shoe of claim 1 including a connector connecting the upstanding portion of the support member to the upper.

12. The shoe of claim 11 wherein the connector is a strap.

13. The shoe of claim 12 wherein the upstanding portion includes an eyelet configured for receiving the strap, the strap being looped through the eyelet and attached to the upper for enhancing lateral support.

14. The shoe of claim 1 wherein the transverse portion of the support member extends laterally relative to the midsole from the first side of the midsole toward an opposite second side of the midsole and terminates between the first and second sides of the midsole.

15. A shoe comprising:

a sole having an outsole and a midsole with at least a portion of the midsole overlying at least a portion of the outsole, the outsole having top and bottom surfaces;

an upper secured to the sole; and a support member having a transverse portion and an upstanding portion, the transverse portion being positioned generally between the midsole and outsole, the transverse portion comprising an inner section spaced laterally from the upstanding portion and a ramped section between the inner section and the upstanding portion, the upstanding portion extending upwardly from the ramped portion and overlapping a portion of the upper, the transverse portion extending laterally relative to the midsole from an area generally adjacent a first side of the midsole toward an opposite second side of the midsole, the ramped section inclining upwardly from a bottom section of the upstanding portion toward the inner section, the upstanding portion extending upwardly from the ramped section adjacent the first side of the midsole, the inner section being moveable between up and down positions, the upstanding portion having a top section moveable between out and in positions, the inner section, ramped section, and upstanding portion being configured so that movement of the inner section from its up position to its down position effectuates movement of the top section of the upstanding portion from its out position to its in position, the upstanding portion being positioned and configured so that when the top section is in its in position, the upstanding portion provides lateral support to a wearer's foot.

16. The shoe of claim 15 wherein the inner section is spaced a first vertical distance from the bottom surface of the outsole when in the up position and is spaced a second vertical distance from the bottom surface of the outsole when in the down position, the second vertical distance being shorter than the first vertical distance, and wherein the top section of the upstanding portion is spaced a first lateral distance from the second side of the midsole when in the out position and is spaced a second lateral distance from the second side of the midsole when in the in position, the second lateral distance being shorter than the first lateral distance.

17. The shoe of claim 16 wherein the inner section of the transverse portion is spaced laterally from the upstanding portion and spaced above the top surface of the outsole when the inner section is in its up position.

18. The shoe of claim 17 including a resilient member between the transverse portion and the outsole for biasing the inner section in its up position.

19. The shoe of claim 18 wherein the resilient member occupies only a portion of a cavity between the transverse portion and the outsole.

20. The shoe of claim 18 wherein the outsole is made of a first material and the resilient member is made of a second material, the second material being more elastically deformable than the first material.

21. The shoe of claim 20 wherein the resilient member is of an elastomeric polyurethane.

22. The shoe of claim 16 wherein the ramped section inclines upwardly at least from a region adjacent the fifth metatarsal head of the wearer's foot to the inner section, and the inner section extends laterally at least from the ramped section to a region adjacent the second metatarsal head of the wearer's foot.

23. The shoe of claim 15 wherein the upstanding portion, ramped portion, and transverse portion constitute a monolithic piece.

24. The shoe of claim 15 including a connector connecting the upstanding portion of the support member to the upper.

25. The shoe of claim 24 wherein the connector is a strap.

26. The shoe of claim 25 wherein the upstanding portion includes an eyelet configured for receiving the strap, the strap being looped through the eyelet and attached to the upper for enhancing lateral support.

* * * * *